US006715504B2

(12) United States Patent
Chen

(10) Patent No.: US 6,715,504 B2
(45) Date of Patent: Apr. 6, 2004

(54) STICK UMBRELLA WITH REINFORCED FRAME

(76) Inventor: Christopher Chen, No. 81, Lane 2, Sec. 1, Chung Hua Road, Hsinchu City (TW)

( * ) Notice: Subject to any disclaimer, the term of this patent is extended or adjusted under 35 U.S.C. 154(b) by 0 days.

(21) Appl. No.: 10/165,956

(22) Filed: Jun. 11, 2002

(65) Prior Publication Data

US 2003/0226582 A1 Dec. 11, 2003

(51) Int. Cl.[7] ..... A45B 25/22
(52) U.S. Cl. ..... 135/27; 135/23; 135/32
(58) Field of Search ..... 135/27, 29, 31, 135/32, 15.1, 23

(56) References Cited

U.S. PATENT DOCUMENTS

| | | | | | |
|---|---|---|---|---|---|
| 559,577 | A | * | 5/1896 | Hadfeild | 135/27 |
| 1,198,881 | A | * | 9/1916 | Shepard | 135/31 |
| 1,378,354 | A | * | 5/1921 | Johnson | 135/26 |
| 2,522,645 | A | * | 9/1950 | Senna | 135/27 |
| 3,042,055 | A | * | 7/1962 | Todorovic | 135/20.1 |
| 4,407,317 | A | * | 10/1983 | Crandall | 135/27 |
| 6,186,157 | B1 | * | 2/2001 | Lin et al. | 135/27 |
| 6,216,712 | B1 | * | 4/2001 | Lin et al. | 135/31 |

FOREIGN PATENT DOCUMENTS

| | | | |
|---|---|---|---|
| GB | 2359745 | * | 9/2001 |

* cited by examiner

*Primary Examiner*—Winnie S. Yip
(74) *Attorney, Agent, or Firm*—Rosenberg, Klein & Lee

(57) ABSTRACT

The present invention relates to a stick type umbrella with reinforced frame including a shaft, which connects with a frame having several sets, such as six sets or eight sets, of main ribs and stretchers. The frame is to provide with two different rib-set structures alternately on the frame. One set is to provide a cord between a middle position of the stretcher and an outer position of the main rib, and the other set is to provide a movable joint at the outer end of the stretcher positioned on the relative main rib between two fixed rings. As the cord pulls the main rib tight and the movable joint functions on the main rib to release wind pressure, the stick type umbrella with the present invention can be quite useful and is capable of avoiding breakage.

4 Claims, 4 Drawing Sheets

STICK UMBRELLA WITH REINFORCED FRAME

BACKGROUND OF THE INVENTION

When an ordinary umbrella without any anti-wind device is used, it would be broken if a strong upward wind occurs suddenly, after blowing the ribs of umbrella reversed upward. If the umbrella is an upward collapsible one, it can be collapsed and then opened for use normally. If it happens to a stick type umbrella, which has straight ribs being unable to fold, the umbrella easily gets broken.

Accordingly, the primary object of the invention is to provide a stick type umbrella with reinforced frame structure, which uses an additional cord to connect the main rib and the relative stretcher and to provide a movable joint at the outer end of the stretcher on the relative main rib. Used in the present invention is a special strong, flexible and non-stretch cord, available on the market and known in the industry. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
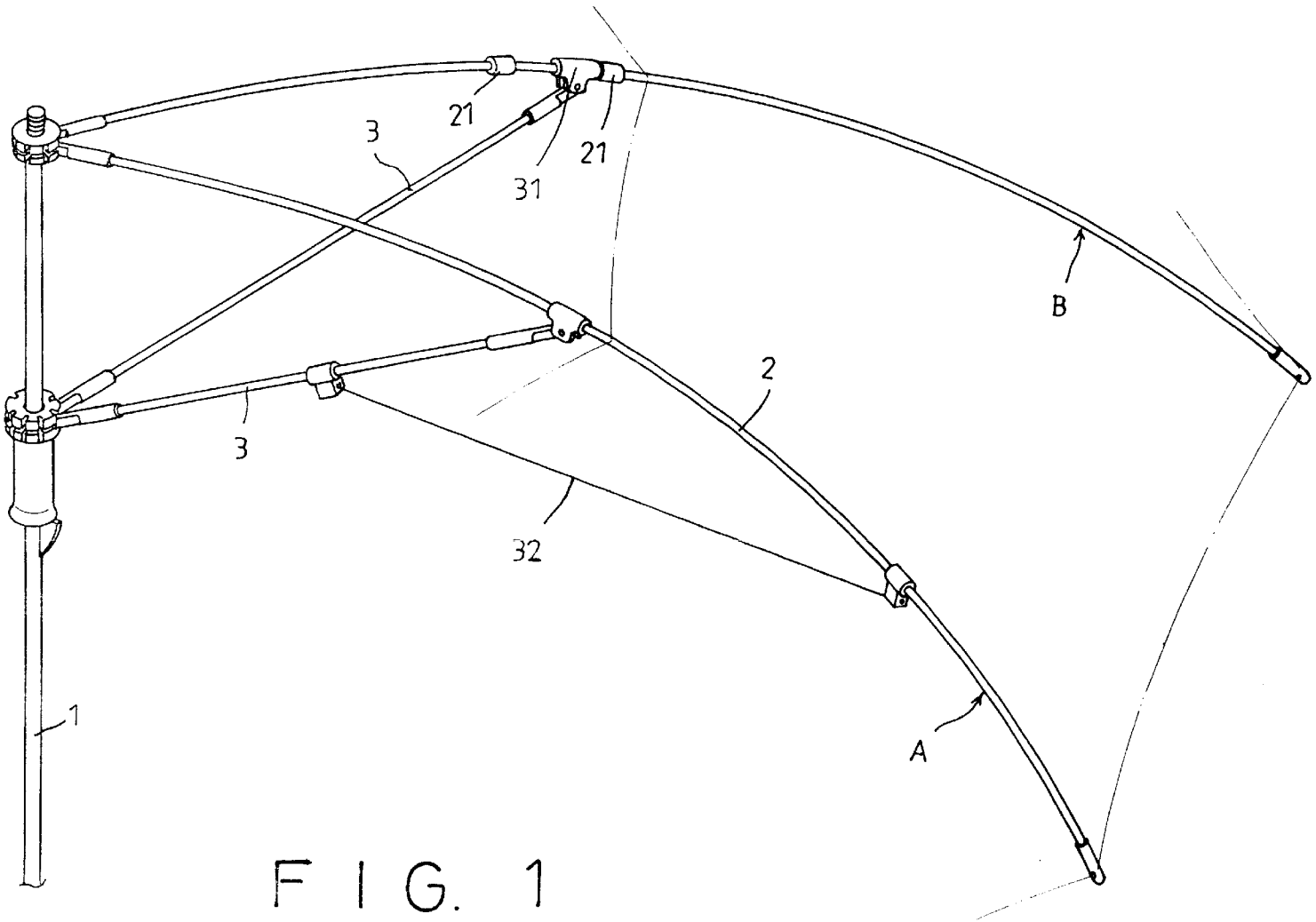
FIG. 1 is a perspective view showing stick type umbrella ribs provided with a reinforcing cord also a movable joint, namely Rib A with the cord and Rib B with the movable joint.
Figure 2:
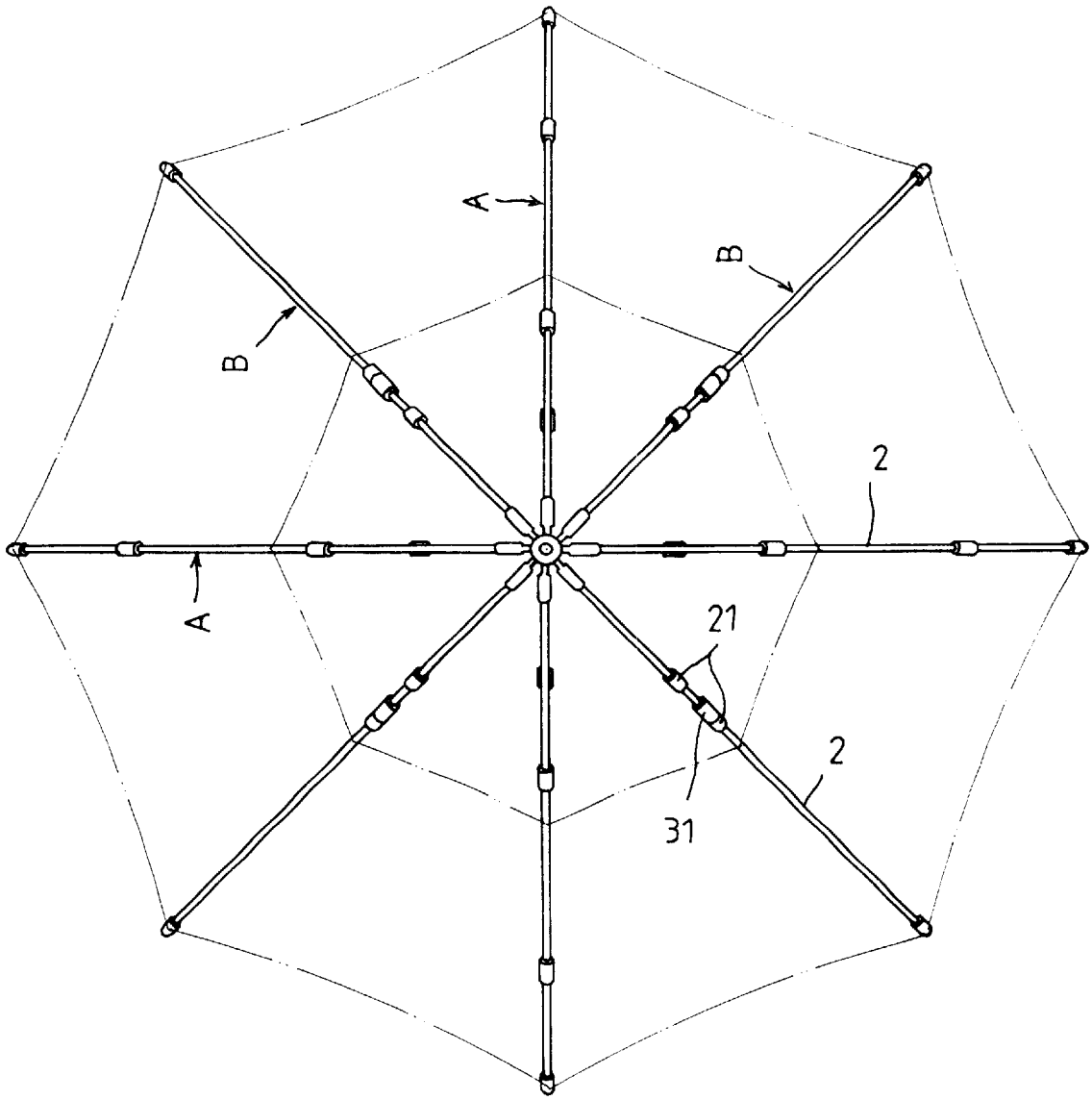
FIG. 2 is a top plan view showing the umbrella being opened.
Figure 3:
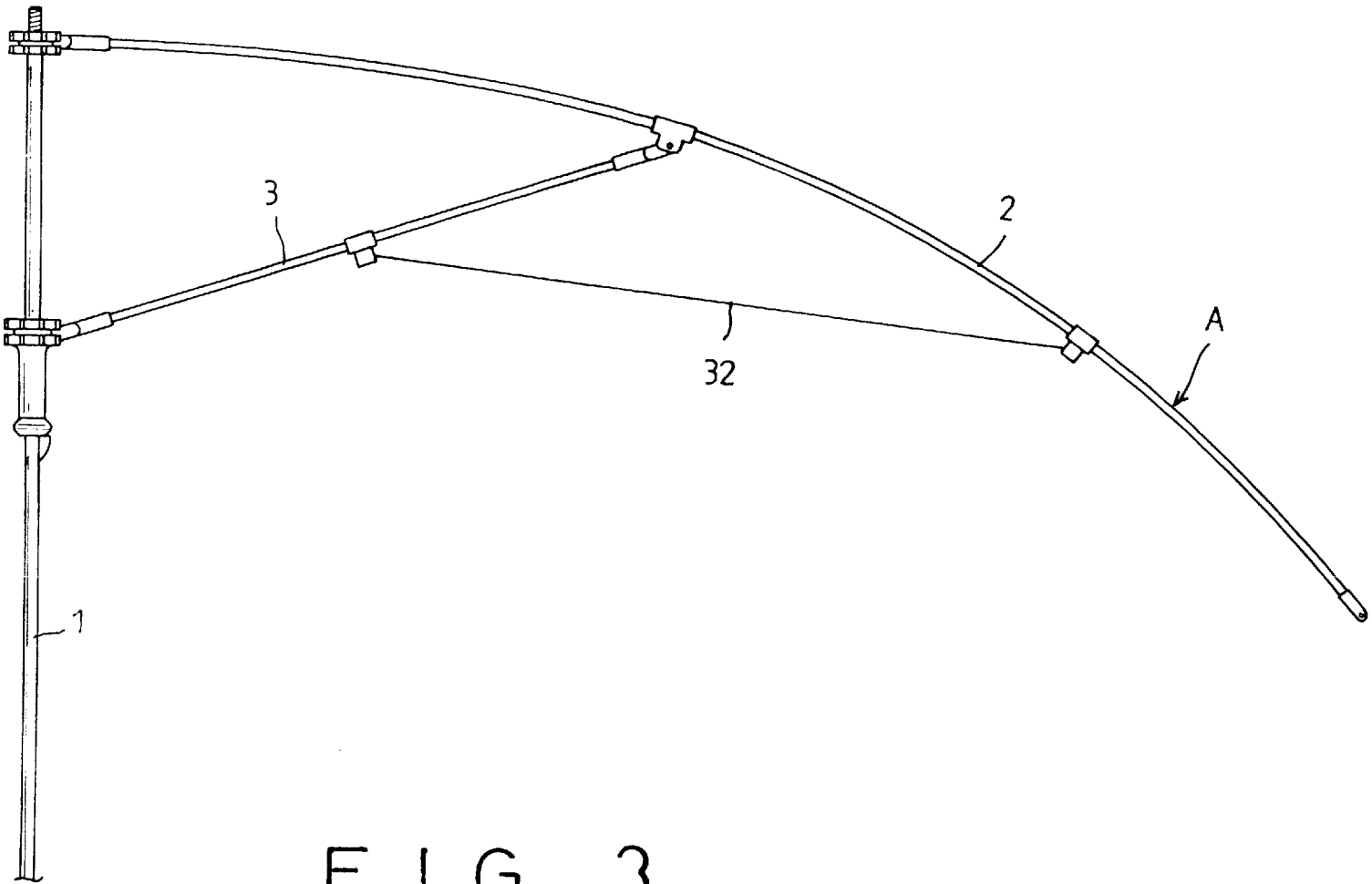
FIG. 3 is a plan view showing a cord connecting the main rib and the relative stretcher.
Figure 4:
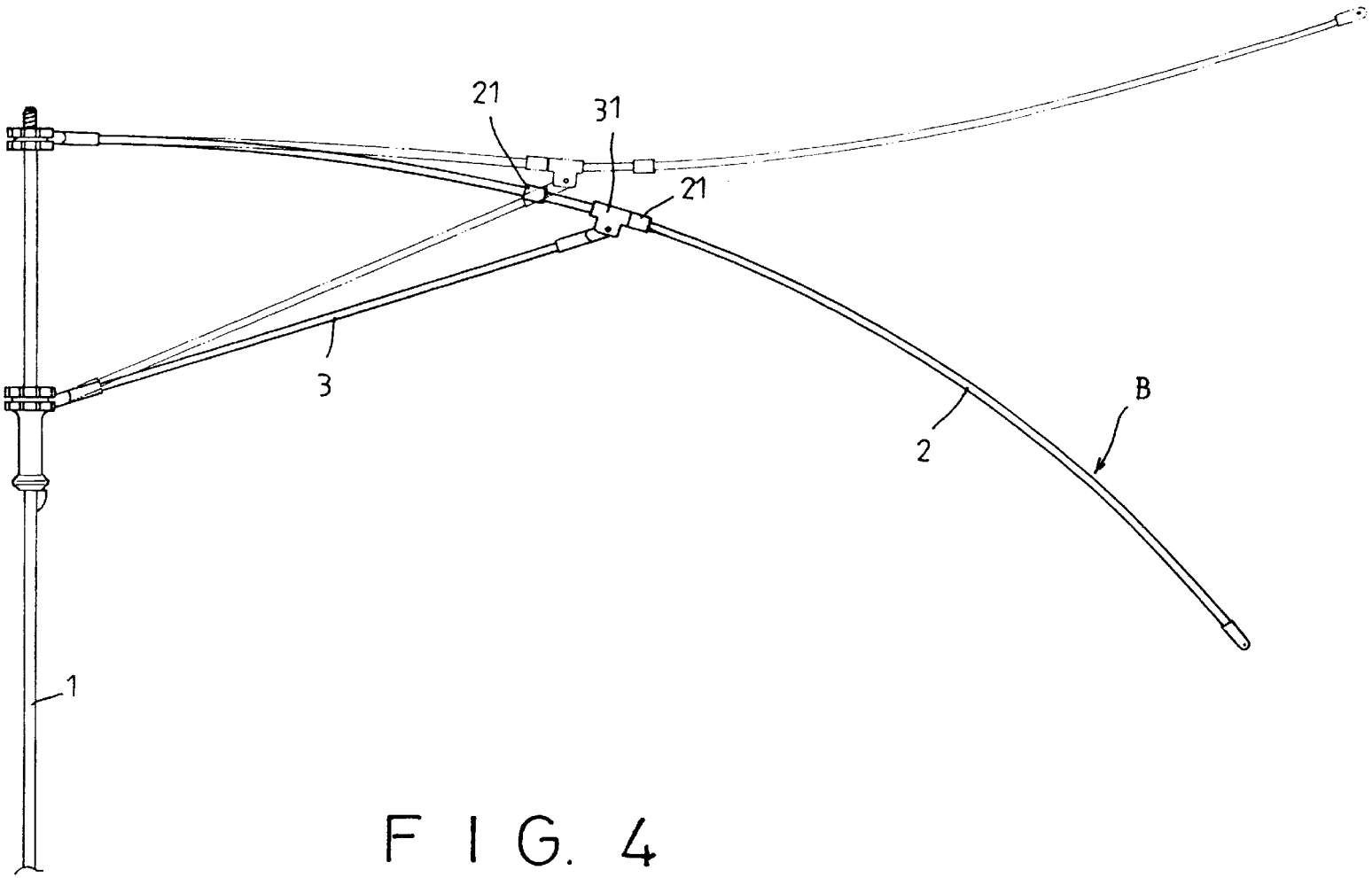
FIG. 4 is a plan view showing a movable joint provided at the outer end of the stretcher and positioned on the middle of the relative main rib, wherein shown are both the normal open position of the rib and the reversed position blown up by strong wind.

Please refer to FIGS. 1 to 3, the present invention mainly relates to an improvement of frame on the main ribs and the stretchers of a stick type umbrella. A normal stick type umbrella includes a shaft (1), which connects with a frame, which includes several sets, such as six sets or eight sets, of main ribs (2) and stretchers (3). The characteristic of the present invention is to provide two different ribs on the frame alternately. One of the two designed structures is to provide a cord (32) between a middle position of the stretcher (3) and an outer position of the main rib (2), as shown in FIG. 3, Rib A. The other structure is to provide a movable joint (31) at the outer end of the stretcher (3) to be positioned on the relative main rib (2) between two fixed rings (21), as shown in FIG. 4, Rib B.

When upward wind happens, the main rib of rib sets having cord (32) is held tight by the cord. On the other hand, the movable joint (31) functions the main rib (2), as shown in FIG. 4, to let the strong wind go away, and the blown up rib automatically comes back, pulled down by Rib A, which never gets blown up. The umbrella according to the present invention achieves a perfect effect in resisting wind.

This is a major objective of the present invention, the function thereof is so to speak "Wind-O-Matic" meaning that the Rib B can be blown up by the strong wind, but it comes back automatically without damage after the wind goes away. There are two more options for assembling Rib A and Rib B, i.e. 1) all with Rib A, which is so to speak "Wind-Lock" meaning that the umbrella ribs never get reversed by the wind. 2) all with Rib B, which is so to speak "Wind-Proof" meaning that the umbrella ribs may get reversed by the strong wind, but can get back to the normal position without damage when the runner is pulled down on the shaft.

Accordingly, the assembly of the present invention obviously achieves utility and improvement. It provides a reinforced frame for the stick type umbrella.

What is claimed is:

1. A stick type umbrella having reinforced frame comprising:

(a) a shaft;

(b) a plurality of stretchers extendable from said shaft; and, (c) a plurality of main ribs extendable from said shaft, each said main rib having an intermediate portion supported by at least one of said stretchers and an outer portion extending from said intermediate portion, said main ribs including:

i. at least one first rib reinforced by a cord coupled to extend from said stretcher to said outer portion thereof; and, ii. at least one second rib having a pair of spaced fixing rings disposed on said intermediate portion, said second rib being coupled to said stretcher by a movable joint slidably engaging said intermediate portion between said fixed rings.

2. The stick type umbrella as recited in claim 1 comprising a plurality of said first ribs.

3. The stick type umbrella as recited in claim 1 comprising a plurality of said second ribs.

4. The stick type umbrella as recited in claim 1 wherein said first and second ribs are disposed in alternating manner about said shaft.

* * * * *